US010871733B2

(12) United States Patent
Takei et al.

(10) Patent No.: US 10,871,733 B2
(45) Date of Patent: Dec. 22, 2020

(54) BELT, INTERMEDIATE TRANSFER BELT, AND IMAGE FORMING APPARATUS

(71) Applicant: FUJI XEROX CO., LTD., Tokyo (JP)

(72) Inventors: Futoshi Takei, Kanagawa (JP); Shigeru Fukuda, Kanagawa (JP); Satoya Sugiura, Kanagawa (JP); Masato Furukawa, Kanagawa (JP); Hiroaki Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/590,926

(22) Filed: Oct. 2, 2019

(65) Prior Publication Data

US 2020/0356029 A1 Nov. 12, 2020

(30) Foreign Application Priority Data

May 10, 2019 (JP) ..... 2019-089933

(51) Int. Cl.
*G03G 15/16* (2006.01)

(52) U.S. Cl.
CPC ..... *G03G 15/162* (2013.01)

(58) Field of Classification Search
USPC ..... 399/308
See application file for complete search history.

(56) References Cited

U.S. PATENT DOCUMENTS

| | | | | |
|---|---|---|---|---|
| 5,832,351 | A | 11/1998 | Takekoshi et al. | |
| 9,733,596 | B1 * | 8/2017 | Furukawa | G03G 15/1685 |
| 2006/0172097 | A1 * | 8/2006 | Morikoshi | G03G 15/161 428/35.7 |
| 2011/0042856 | A1 * | 2/2011 | Aoto | G03G 15/161 264/334 |

FOREIGN PATENT DOCUMENTS

| | | | |
|---|---|---|---|
| JP | 06149079 | A * | 5/1994 |
| JP | 2002-316369 | A | 10/2002 |
| JP | 3391946 | B2 | 3/2003 |
| JP | 2004295070 | A * | 10/2004 |
| JP | 2009-237364 | A | 10/2009 |
| JP | 2009-258699 | A | 11/2009 |
| JP | 5307523 | B2 | 7/2013 |
| JP | 5470771 | B2 | 2/2014 |

* cited by examiner

*Primary Examiner* — Quana Grainger
(74) *Attorney, Agent, or Firm* — Sughrue Mion, PLLC

(57) ABSTRACT

A belt includes a first layer defining an outer peripheral surface of the belt and a second layer arranged adjacent to the first layer. The first and second layers include a polyimide-based resin. The first layer includes carbon black particles. A part of the carbon black particles which are exposed at the outer peripheral surface of the belt have a size of 5 nm or more and 150 nm or less. The area fraction of the part of the carbon black particles which are exposed at the outer peripheral surface of the belt to the outer peripheral surface of the belt is 2% or more and 35% or less. The belt includes 80 or more conducting points per square micrometer and has a volume resistivity of 10 log Ω·cm or more.

20 Claims, 1 Drawing Sheet

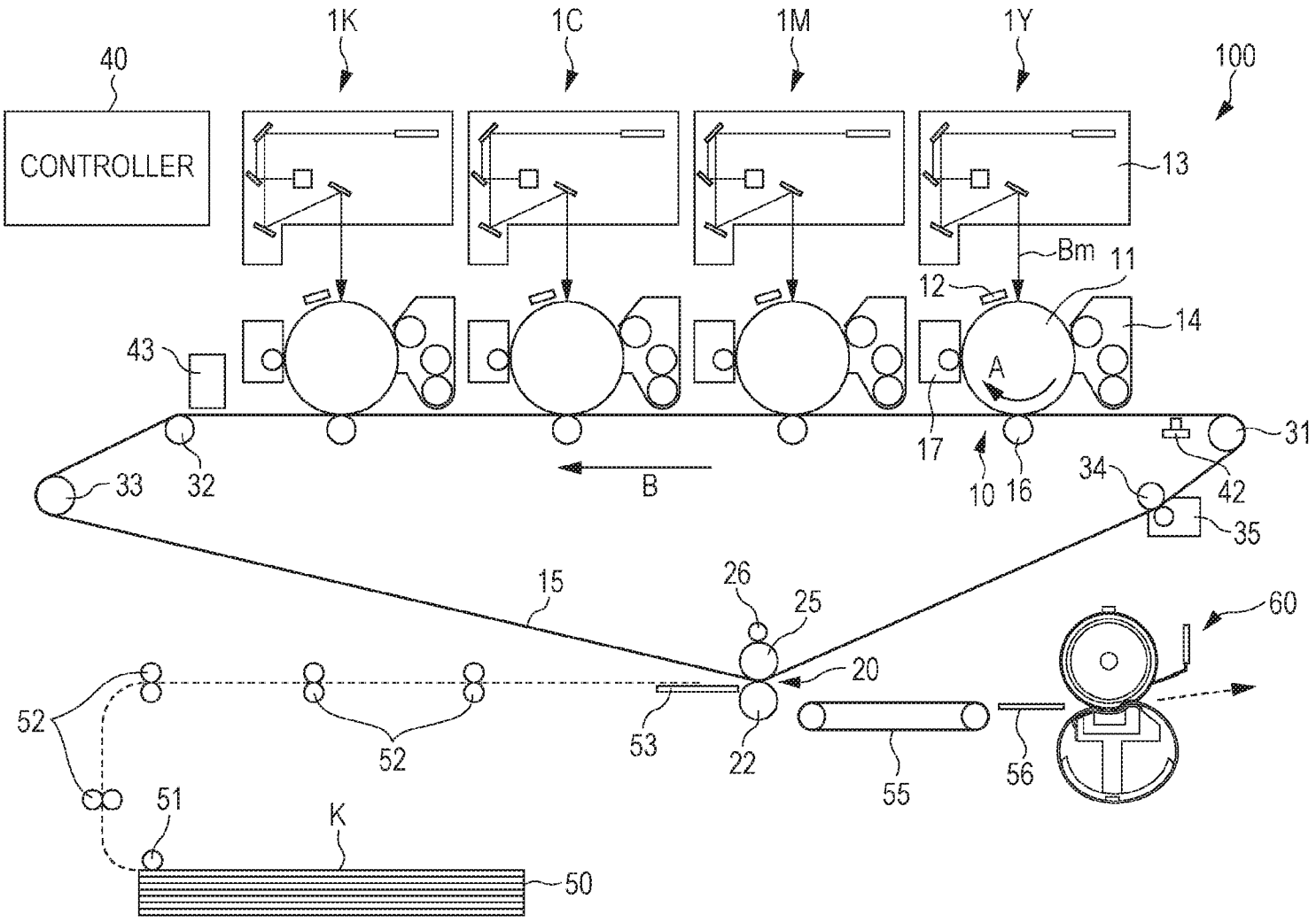
100
1Y
1M
1C
1K
13
14
11
Bm
12
A
16
10
17
31
42
35
34
60
56
55
20
25
26
22
53
B
15
50
52
K
51
32
33
43
40
CONTROLLER

BELT, INTERMEDIATE TRANSFER BELT, AND IMAGE FORMING APPARATUS

CROSS-REFERENCE TO RELATED APPLICATIONS

This application is based on and claims priority under 35 USC 119 from Japanese Patent Application No. 2019-089933 filed May 10, 2019.

BACKGROUND

(i) Technical Field

The present disclosure relates to a belt, an intermediate transfer belt, and an image forming apparatus.

(ii) Related Art

Electrophotographic image forming apparatuses (e.g., a copying machine, a facsimile, and a printer) form an image by transferring a toner image formed on the surface of an image holding member onto the surface of a recording medium and fixing the toner image to the recording medium. When the toner image is transferred to a recording medium, an electrically conductive belt, such as an intermediate transfer belt, is used.

For example, Japanese Laid Open Patent Application Publication No. 2009-237364 discloses an intermediate transfer body consisting of only one layer including a polyamideimide resin and carbon black particles, the proportion of a part of the carbon black particles which are exposed at the surface of the intermediate transfer body in the surface being 20% or less.

Japanese Laid Open Patent Application Publication No. 2009-258699 discloses a circular body for use in electrophotographic image forming apparatuses, the circular body including at least two layers that are an inner layer and an outer layer disposed on a surface of the inner layer which faces the outer peripheral surface of the circular body. The amount of carbon black included in the outer layer per unit volume is smaller than the amount of carbon black included in the inner layer per unit volume.

Japanese Laid Open Patent Application Publication No. 2002-316369 discloses a tubular aromatic polyimide resin-based multilayer film that is a tubular multilayer film including a base layer composed of a non-thermoplastic aromatic polyimide resin and a layer composed of a thermoplastic aromatic polyamideimide resin which is disposed on the base layer. One or both of the base layer composed of a non-thermoplastic aromatic polyimide resin and the layer composed of a thermoplastic aromatic polyamideimide resin have different degrees of semiconductivity.

SUMMARY

Belts produced by dispersing carbon black particles in a resin are electrically conductive and therefore likely to be subjected to an electric field generated by the voltage applied.

Belts produced by dispersing carbon black particles in a resin are likely to severely discharge in the electric field.

Aspects of non-limiting embodiments of the present disclosure relate to a belt that is less likely to discharge in an electric field than a belt in which carbon black particles exposed at the outer peripheral surface of the belt have a size of more than 150 nm, a belt in which the area fraction of carbon black particles exposed at the outer peripheral surface of the belt to the outer peripheral surface of the belt is less than 20%, a belt including less than 80 conducting points per square micrometer, or a belt having a volume resistivity of less than 10 log Ω·cm.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a belt including a first layer defining an outer peripheral surface of the belt and a second layer arranged adjacent to the first layer. The first and second layers include a polyimide-based resin. The first layer includes carbon black particles. A part of the carbon black particles which are exposed at the outer peripheral surface of the belt have a size of 5 nm or more and 150 nm or less. The area fraction of the part of the carbon black particles which are exposed at the outer peripheral surface of the belt to the outer peripheral surface of the belt is 2% or more and 35% or less. The belt includes 80 or more conducting points per square micrometer and has a volume resistivity of 10 log Ω·cm or more.

BRIEF DESCRIPTION OF THE DRAWING

Exemplary embodiments of the present disclosure will be described in detail based on the following FIGURE, wherein:

FIGURE is a schematic diagram illustrating an example of an image forming apparatus according to an exemplary embodiment.

DETAILED DESCRIPTION

Exemplary embodiments are described below. The following description and Examples below are intended to be illustrative of the exemplary embodiments and not restrictive of the scope of the exemplary embodiments.

In the exemplary embodiments, a numerical range expressed using "to" means the range specified by the minimum and maximum described before and after "to", respectively.

In the exemplary embodiments, when numerical ranges are described in a stepwise manner, the upper or lower limit of a numerical range may be replaced with the upper or lower limit of another numerical range, respectively. In the exemplary embodiments, the upper and lower limits of a numerical range may be replaced with the upper and lower limits described in Examples below.

The term "step" used herein refers not only to an individual step but also to a step that is not distinguishable from other steps but achieves the intended purpose of the step.

In the exemplary embodiments, when an exemplary embodiment is described with reference to a drawing, the structure of the exemplary embodiment is not limited to the structure illustrated in the drawing. The sizes of the members illustrated in the attached drawing are conceptual and do not limit the relative relationship among the sizes of the members.

Each of the components described in the exemplary embodiments may include plural types of substances that correspond to the component. In the exemplary embodiments, in the case where a composition includes plural substances that correspond to a component of the composition, the content of the component in the composition is the total content of the plural substances in the composition unless otherwise specified.

Belt

A belt according to an exemplary embodiment includes a first layer defining an outer peripheral surface of the belt and a second layer arranged adjacent to the first layer. The first and second layers include a polyimide-based resin. The first layer includes carbon black particles. A part of the carbon black particles which are exposed at the outer peripheral surface of the belt have a size of 5 nm or more and 150 nm or less. The area fraction of the part of the carbon black particles which are exposed at the outer peripheral surface of the belt to the outer peripheral surface of the belt is 2% or more and 35% or less. The belt includes 80 or more conducting points per square micrometer and has a volume resistivity of 10 log Ω·cm or more.

The belt according to the exemplary embodiment is an electrically conductive belt and may be suitably used as an intermediate transfer belt included in an electrophotographic image forming apparatus.

The belt according to the exemplary embodiment may be resistant to discharging in an electric field. The reasons for this are not clarified and may be the following.

Carbon black particles are exposed at the outer peripheral surface of the belt, which is defined by the first layer. The exposed carbon black particles have small sizes. Moreover, the area fraction of the exposed carbon black particles to the outer peripheral surface of the belt is 2% or more.

In other words, a large amount of small carbon black particles are dispersed in and exposed at the outer peripheral surface of the belt according to the exemplary embodiment.

Furthermore, the belt according to the exemplary embodiment includes 80 or more conducting points per square micrometer and has a volume resistivity of 10 log Ω·cm or more. This may reduce the amount of discharge, increase the likelihood of generation of a uniform electric field, and consequently reduce the likelihood of the belt severely discharging locally in the electric field. As a result, the number of discharges and the amount of discharge may be reduced.

The belt according to the exemplary embodiment may be an open-end belt or an endless belt. The belt according to the exemplary embodiment may be a belt that includes a first layer, a second layer, and a layer other than the first or second layer.

The term "polyimide-based resin" used herein refers to a polymer that includes a repeating unit including an imide linkage. Specific examples of the polyimide-based resin include a polyimide resin, a polyamideimide resin, and a polyetherimide resin.

First Layer

The belt according to the exemplary embodiment includes a first layer that defines the outer peripheral surface of the belt. The first layer includes a polyimide-based resin and carbon black particles. A part of the carbon black particles which are exposed at the outer peripheral surface of the belt, which is defined by the first layer, have a size of 5 nm or more and 150 nm or less. The area fraction of the exposed carbon black particles to the outer peripheral surface of the belt is 2% or more and 35% or less.

Carbon Black Particles Exposed at Outer Peripheral Surface of Belt

Carbon black particles are exposed at the outer peripheral surface of the belt, which is defined by the first layer. When the exposed carbon black particles satisfy the following conditions, the belt according to the exemplary embodiment may be resistant to discharging.

The size of the exposed carbon black particles is 5 nm or more and 150 nm or less, is preferably 5 nm or more and 130 nm or less, and is more preferably 5 nm or more and 100 nm or less.

The area fraction of the exposed carbon black particles to the outer peripheral surface of the belt is 2% or more and 35% or less, is preferably 3% or more and 30% or less, and is more preferably 5% or more and 20% or less.

In order to control the size of the carbon black particles exposed at the outer peripheral surface of the belt and the area fraction of the exposed carbon black particles to the outer peripheral surface of the belt to fall within the respective ranges, for example, the size of the carbon black particles included in the first layer, the content of the carbon black particles in the first layer, and the state of dispersion of the carbon black particles in the first layer may be adjusted appropriately. Alternatively, the conditions under which the layer is formed by heating may also be adjusted in order to control the average size of the carbon black particles exposed at the outer peripheral surface of the belt and the area fraction of the exposed carbon black particles to the outer peripheral surface of the belt to fall within the respective ranges.

A method for determining the above particle size and area fraction is described below.

Three specimens are prepared by cutting the belt to a size of 5 mm×5 mm.

The outer peripheral surface of each of the specimens is observed with a scanning electron microscope (SEM). In the resulting images, low-contrast portions represent carbon black particles and high-contrast portions represent a resin. On the basis of the difference in contrast, the images are transformed into a binary representation. Then, the area fraction of the exposed carbon black particles is calculated. The area fraction described above is the average of the area fractions calculated using nine images obtained by observing each of the three specimens in three fields of view.

The size of the exposed carbon black particles is determined by measuring the length of the major axis of each of the aggregates of carbon black particles included in the nine images. The size of the exposed carbon black particles is represented as the minimum and maximum lengths of the major axes of the aggregates.

Polyimide-Based Resin

The first layer includes a polyimide-based resin in consideration of the dispersibility of carbon black particles, mechanical strength, dimensional stability, electrical stability, heat resistance, and the like.

The polyimide-based resin may be a polyimide resin or a polyamideimide resin. In particular, the first layer may include a polyamideimide resin in order to increase the dispersibility of carbon black particles (specifically, the dispersibility of carbon black particles having smaller sizes).

Polyamideimide Resin

The polyamideimide resin may be any resin including a repeating unit including an imide linkage and an amide linkage.

Specific examples of the polyamideimide resin include a polymer produced by polymerization of a trivalent carboxylic acid compound (i.e., tricarboxylic acid) having an acid anhydride group with a diisocyanate or diamine compound.

The tricarboxylic acid may be trimellitic anhydride or a derivative of trimellitic anhydride. The tricarboxylic acid may be used in combination with a tetracarboxylic dianhydride, an aliphatic dicarboxylic acid, an aromatic dicarboxylic acid, or the like.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have a structure similar to that of any of the above isocyanates and include amino groups instead of isocyanato groups.

The first layer may include only one type of polyamideimide resin or two or more types of polyamideimide resins.

The content of the polyamideimide resin in the first layer is preferably 20% by mass or more and 85% by mass or less, is more preferably 40% by mass or more and 80% by mass or less, and is further preferably 50% by mass or more and 75% by mass or less of the total mass of the first layer in order to reduce discharging.

Carbon Black Particles

The first layer includes carbon black particles.

Since carbon black particles have a high electrical conductivity, carbon black particles are capable of increasing electrical conductivity to a high degree even when the amount of carbon black particles used is small.

Examples of the carbon black particles included in the first layer include Ketjenblack, oil-furnace black, channel black, acetylene black, and surface-oxidized carbon black (hereinafter, referred to as "surface-treated carbon black"). Among these, surface-treated carbon black is preferable in terms of consistency of electric resistance over time.

Surface-treated carbon black particles may be produced by attaching a carboxyl group, a quinone group, a lactone group, a hydroxyl group, or the like to the surfaces of carbon black particles. Examples of a method for treating the surfaces of carbon black particles include an air oxidation method in which carbon black particles are brought into contact with air in a high-temperature atmosphere to cause a reaction, a method in which carbon black particles are caused to react with a nitrogen oxide or ozone at normal temperature (e.g., 22° C.), and a method in which air oxidation of carbon black particles is performed in a high-temperature atmosphere and the carbon black particles are oxidized using ozone at a low temperature.

The average primary particle size of the carbon black particles included in the first layer is preferably 2 nm or more and 20 nm or less, is more preferably 2 nm or more and 18 nm or less, and is particularly preferably 2 nm or more and 15 nm or less in consideration of dispersibility and exposure of the carbon black particles at the surface.

In the exemplary embodiment, the average primary particle size of carbon black particles is determined by the following method.

A specimen having a thickness of 100 nm is taken from the belt with a microtome. The specimen is observed with a transmission electron microscope (TEM). For each of 50 carbon black particles, the diameter of a circle having an area equal to the projected area of the carbon black particle is calculated as the size of the carbon black particle. The average of the sizes of the 50 carbon black particles is considered the average primary particle size of carbon black particles.

The first layer may include only one type of carbon black particles or two or more types of carbon black particles.

The content of the carbon black particles in the first layer is preferably 15% by mass or more, is more preferably 15% by mass or more and 30% by mass or less, and is further preferably 16% by mass or more and 22% by mass or less of the total mass of the first layer in order to reduce discharging.

Other Constituents

The first layer may include a constituent other than the above-described constituents.

Examples of the other constituent include a conductant agent other than carbon black particles, a filler used for increasing the strength of the belt, an antioxidant used for preventing the belt from becoming degraded by heat, a surfactant used for improving fluidity, and a heat-resistant antioxidant.

In the case where the first layer includes the other constituent, the content of the other constituent in the first layer is preferably more than 0% by mass and 10% by mass or less, is more preferably more than 0% by mass and 5% by mass or less, and is further preferably more than 0% by mass and 1% by mass or less of the total mass of the first layer.

Surface Quality

The surface roughness Rz of the outer peripheral surface of the belt is preferably 0.2 μm or less, is more preferably 0.15 μm or less, and is further preferably 0.1 μm or less.

Surface roughness Rz is a parameter measured in the height direction which is referred to as "maximum height" and is specifically the sum of the maximum height of the peaks and the maximum depth of the valleys which occur in a roughness profile of a sampling length, which is defined in JIS B 0601:2013.

The surface roughness height Rz of the outer peripheral surface of the belt is measured in the following manner.

Three specimens are prepared by cutting the belt to a size of 3 mm×3 mm.

The surface roughness of the outer peripheral surface of each of the specimens is measured at random positions with a surface roughness tester "SURFCOM" produced by Tokyo Seimitsu Co., Ltd. The measurement is conducted with a measurement length of 2.5 mm, a cutoff wavelength of 0.8 mm, and a measurement speed of 0.60 mm/s. The measurement is conducted at three positions for each specimen, and the average of the roughness values measured at the three positions is considered the surface roughness Rz of the specimen.

The above measurement is conducted for each of the three specimens, and the average of the roughness values of the three specimens is considered the surface roughness Rz of the outer peripheral surface of the belt according to the exemplary embodiment.

Thickness

The thickness of the first layer is preferably 1 μm or more and 20 μm or less and is more preferably 3 μm or more and 15 μm or less in order to increase ease of production and reduce discharging.

The thickness of the first layer is determined by the following method.

A cross section of the belt taken in the thickness direction is observed with an optical microscope or a scanning electron microscope. The thickness of the first layer is measured at 10 positions, and the average thereof is considered the thickness of the first layer. This method applies also to the measurement of the thickness of the second layer, which is described below.

Second Layer

The belt according to the exemplary embodiment includes a second layer arranged adjacent to the first layer. The second layer includes a polyimide-based resin.

The second layer may be a layer that defines the inner peripheral surface of the belt, that is, a surface of the belt which is opposite to the outer peripheral surface of the belt.

Polyimide-Based Resin

The second layer includes a polyimide-based resin in consideration of, for example, the dispersibility of carbon black particles, mechanical strength, dimensional stability, electrical stability, and heat resistance.

The polyimide-based resin may be a polyimide resin or a polyamideimide resin and is preferably a polyimide resin in order to increase mechanical strength.

Polyimide Resin

Examples of the polyimide resin include a polyimide resin produced by imidization of a polyamic acid (i.e., a precursor of a polyimide resin), which is a polymer produced by polymerization of a tetracarboxylic dianhydride with a diamine compound.

Examples of the polyimide resin include a resin including the structural unit represented by General Formula (I) below.

(I)

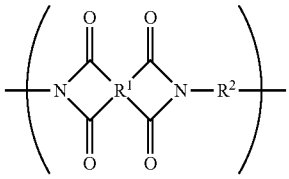

In General Formula (I), $R^1$ represents a tetravalent organic group and $R^2$ represents a divalent organic group.

Examples of the tetravalent organic group represented by $R^1$ include an aromatic group, an aliphatic group, a cyclic aliphatic group, a group that includes an aromatic group and an aliphatic group, and groups formed by substituting the above groups with a substituent. Specific examples of the tetravalent organic group include a residue of the tetracarboxylic dianhydride described below.

Examples of the divalent organic group represented by $R^2$ include an aromatic group, an aliphatic group, a cyclic aliphatic group, a group that includes an aromatic group and an aliphatic group, and groups formed by substituting the above groups with a substituent. Specific examples of the divalent organic group include a residue of the diamine compound described below.

Specific examples of the tetracarboxylic dianhydride used as a raw material for the polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine compound used as a raw material for the polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The second layer may include only one type of polyimide resin or two or more types of polyimide resins.

The content of the polyimide resin in the second layer is preferably 50% by mass or more and 90% by mass or less, is more preferably 60% by mass or more and 85% by mass or less, and is further preferably 70% by mass or more and 85% by mass or less of the total mass of the second layer in order to reduce discharging and increase the mechanical strength of the belt.

Carbon Black Particles

The second layer may include carbon black particles in order to, for example, control the number of conducting points present on the belt according to the exemplary embodiment and the volume resistivity of the belt.

Examples of the carbon black particles included in the second layer include Ketjenblack, oil-furnace black, channel black, acetylene black, and the surface-treated carbon black, which are the same as the examples of the carbon black particles included in the first layer. A preferable example of the carbon black particles included in the second layer is also the same as the preferable example of the carbon black particles included in the first layer.

The average primary particle size of the carbon black particles included in the second layer is preferably more than 20 nm and 40 nm or less, is more preferably more than 20 nm and 37 nm or less, and is particularly preferably 20 nm or more and 35 nm or less in order to enhance dispersibility (in particular, dispersibility in a polyimide resin), increase the mechanical strength of the second layer, and make it easy to control the number of conducting points present on the belt and the volume resistivity of the belt.

The second layer may include only one type of carbon black particles or two or more types of carbon black particles.

The content of the carbon black particles in the second layer is preferably 10% by mass or more and 40% by mass or less, is more preferably 13% by mass or more and 35% by mass or less, and is further preferably 20% by mass or more and 30% by mass or less of the total mass of the second layer in order to enhance dispersibility (in particular, dispersibility in a polyimide resin), increase the mechanical strength of the second layer, and make it easy to control the number of the conducting points and the volume resistivity of the belt.

Other Constituents

The second layer may include a constituent other than the above-described constituents.

Examples of the other constituent include constituents that are the same as the other constituents of the first layer.

In the case where the second layer includes the other constituent, the content of the other constituent in the second layer is preferably more than 0% by mass and 10% by mass or less, is more preferably more than 0% by mass and 5% by mass or less, and is further preferably more than 0% by mass and 1% by mass or less of the total mass of the second layer.

Thickness

The thickness of the second layer is preferably 50 μm or more and 100 μm or less and is more preferably 60 μm or more and 80 μm or less in order to increase the mechanical strength of the belt.

Number of Conducting Points

The belt according to the exemplary embodiment includes 80 or more conducting points per square micrometer.

The number of the conducting points included in the belt according to the exemplary embodiment per square micrometer is preferably 90 or more and is more preferably 100 or more.

The maximum number of the conducting points is, for example, 400.

In the exemplary embodiment, the number of the conducting points included in the belt per square micrometer is determined by the following method.

A small piece (2 cm×2 cm) is taken from the belt. A conductive double-stick tape is attached to the surface of the small piece. Subsequently, electrostatic removal of the small piece is performed. Hereby, a specimen is prepared.

While a test voltage of −20 V is applied to the surface of the specimen, in an air atmosphere, the specimen is subjected to conductive AFM using "Nanoscope IIIa+D3100" produced by Digital Instruments with a resolution of 512×512 per square micrometer. The points at which a current of 3.0 pA or more flows between the probe and the conductive double-stick tape are determined as conducting points.

The number of the conducting points per square micrometer is determined by an image analysis of the conducting points. Plural conducting points adjacent to one another are collectively counted as one.

Volume Resistivity

The belt according to the exemplary embodiment has a volume resistivity of 10.0 log Ω·cm or more. The maximum volume resistivity of the belt is, for example, 13.5 log Ω·cm.

The volume resistivity of the belt is determined by the following method.

The volume resistivity [log Ω·cm] of the belt is measured using a micro current meter "R8430A" produced by Advantest Corporation as a resistance meter and a UR probe produced by Mitsubishi Chemical Corporation as a probe at the center and both edges of the belt in the width direction for each of 6 positions spaced at regular intervals in the circumferential direction, that is, 18 positions in total, with an applied voltage of 100 V, a voltage application time of 5 seconds, and a pressure of 1 kgf. The average of the volume resistivity values is calculated. The above measurement is conducted at 22° C. and 55% RH.

Surface Resistivity

In order to further reduce discharging, the belt according to the exemplary embodiment may satisfy Formulae (1) and (2) below, $$\rho s1 \geq 10.9 \log \Omega/sq \quad (1)$$

$$0 < |\rho s1 - \rho s2| \leq 0.3 \quad (2)$$

where ρs1 represents the surface resistivity of the outer peripheral surface of the belt, and ρs2 represents the surface resistivity of a surface of the belt which is opposite to the outer peripheral surface of the belt, that is, the inner peripheral surface of the belt.

Specifically, Formula (1) indicates that the surface resistivity ρs1 of the outer peripheral surface of the belt according to the exemplary embodiment is 10.9 log Ω/sq or more. The surface resistivity ρs1 of the outer peripheral surface of the belt is preferably 11.0 log Ωsq or more and is more preferably 11.3 log Ωsq or more. The maximum surface resistivity ρs1 of the outer peripheral surface of the belt is, for example, 14.0 log Ωsq.

Formula (2) indicates that the surface resistivity ρs1 of the outer peripheral surface of the belt according to the exemplary embodiment is not equal to the surface resistivity ρs2 of the inner peripheral surface of the belt, and that the absolute value of the difference between the surface resistivity ρs1 of the outer peripheral surface of the belt and the surface resistivity ρs2 of the inner peripheral surface of the belt is 0.3 or less.

When Formulae (1) and (2) above are satisfied, in the case where the belt according to the exemplary embodiment is used as an intermediate transfer belt, transfer efficiency may be increased.

The surface resistivity ρs2 of the inner peripheral surface of the belt may be set such that Formula (2) above is satisfied. The surface resistivity ρs2 of the inner peripheral surface of the belt is preferably, for example, 11.0 log Ωsq or more and 14.0 log Ω/sq or less and is more preferably 11.0 log Ωsq or more and 12.5 log Ω/sq or less.

The surface resistivity of the belt is determined by the following method.

The surface resistivity [log Ω/sq] of the belt is measured using a micro current meter "R8430A" produced by Advantest Corporation as a resistance meter and a UR probe produced by Mitsubishi Chemical Corporation as a probe at the center and both edges of the belt in the width direction for each of 6 positions spaced at regular intervals in the circumferential direction, that is, 18 positions in total, with an applied voltage of 100 V, a voltage application time of 3 seconds, and a pressure of 1 kgf. The average of the surface resistivity values is calculated. The above measurement is conducted at 22° C. and 55% RH.

When the UR probe is pressed against the outer peripheral surface of the belt, the surface resistivity ρs1 of the outer peripheral surface of the belt can be measured. Similarly, when the UR probe is pressed against the inner peripheral surface of the belt, the surface resistivity ρs2 of the inner peripheral surface of the belt can be measured.

Folding Endurance Number

The belt according to the exemplary embodiment may have flex resistance in consideration of possible applications of the belt. Accordingly, the folding endurance number of the belt according to the exemplary embodiment which is determined by an MIT test using a clamp having a curvature radius R of 0.38 mm may be 3,000 or more.

The above folding endurance number is more preferably 4,000 or more and is further preferably 5,000 or more.

The folding endurance number of the belt according to the exemplary embodiment is measured in the following manner.

The MIT test is based on JIS P 8115:2001 (MIT Method).

Specifically, a strip-shaped specimen having a width of 15 mm and a length of 200 mm is taken from the belt in the circumferential direction. While the ends of the strip-shaped specimen are fixed and a tensile force of 1 kgf is applied to the specimen, the specimen is repeatedly bent (folded) 90° to and from with a clamp having a curvature radius R of 0.38 mm serving as a pivot. The number of times the strip-shaped specimen has been bent until the specimen becomes raptured is considered a folding endurance number.

The MIT test is conducted at 22° C. and 55% RH.

Applications

The application of the belt according to the exemplary embodiment is not limited. The belt according to the exemplary embodiment may be used for any application in which, specifically, the conducting properties of the belt are required. In particular, the belt according to the exemplary embodiment may be used for an application in which a voltage is applied to the belt since the belt is resistant to discharging that may occur when a voltage is applied between the belt and another member to generate an electric field.

The belt according to the exemplary embodiment may be used as a component of an electrophotographic image forming apparatus, such as a belt member included in a transfer device (e.g., an intermediate transfer belt, a recording medium transport belt, a first transfer belt, or a second transfer belt) or a belt member included in a charging device (e.g., a charging belt). In particular, the belt according to the exemplary embodiment may be used as an intermediate transfer belt.

In addition, a roller member produced by covering a roller composed of a metal, resin, or the like with the belt may be used as a roller member included in a transfer device, a charging device, or the like.

The belt according to the exemplary embodiment may also be used as, for example, a hollow cylindrical base for solar batteries.

The belt according to the exemplary embodiment may also be used as, for example, a belt-shaped member, such as a driving belt, a lamination belt, an electrical insulating material, a pipe coating material, an electromagnetic wave insulating material, a heat source insulator, or an electromagnetic wave absorption film.

Method for Producing Belt

The method for producing the belt according to the exemplary embodiment is not limited and may be any method capable of forming the first and second layers such that the first and second layers are adjacent to each other.

One of the methods for producing the belt according to the exemplary embodiment is the following.

A coating liquid A that includes carbon black particles dispersed therein and a polyamic acid (i.e., a precursor of a polyimide resin) dissolved therein is prepared. A coating liquid B that includes carbon black particles dispersed therein and a polyamideimide resin dissolved therein is also prepared.

In the preparation of the coating liquids A and B, a dispersion treatment may be performed using a pulverizer, such as a jet mill, in order to disintegrate aggregates of carbon black particles and enhance the dispersibility of carbon black particles.

The coating liquid A is applied to a hollow or solid cylinder. The resulting coating film is dried to form a second layer. The coating liquid B is applied to the second layer, and the resulting coating film is dried to form a first layer.

Imidization of the polyamic acid included in the coating liquid A is performed after the coating film formed of the coating liquid A has been dried or after the first layer has been formed on the second layer. That is, heating for imidization may be performed after the coating film formed of the coating liquid A has been dried or after the first layer has been formed on the second layer.

In the heating for imidization, for example, heating is performed at 150° C. or more and 450° C. or less (preferably 200° C. or more and 430° C. or less) for 20 minutes or more and 90 minutes or less (preferably 40 minutes or more and 70 minutes or less). This causes an imidization reaction to produce a polyimide.

The solvent used for preparing the coating liquids A and B is not limited and may be selected appropriately in accordance with the resin and the like that are to be dissolved in the solvent. For example, the solvent used for preparing the coating liquids A and B may be the polar solvent described below.

Although the second layer is formed by coating in the above method, alternatively, the second layer may be formed by the following method:

a method in which a pellet including a polyimide resin and carbon black particles is prepared and the pellet is melt-extruded to form a second layer.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylphosphoramide (HMPA), N-methylcaprolactam, N-acetyl-2-pyrrolidone, and 1,3-dimethyl-2-imidazolidinone (N,N-dimethylimidazolidinone, DMI). The above polar solvents may be used alone or in combination of two or more.

Image Forming Apparatus

An image forming apparatus according to an exemplary embodiment includes the belt according to the above-described exemplary embodiment.

Specifically, the image forming apparatus according to the exemplary embodiment includes an image holding member; a charging device that charges the surface of the image holding member; an electrostatic-latent image formation device that forms an electrostatic latent image on the charged surface of the image holding member; a developing device that includes a developer including a toner and develops the electrostatic latent image formed on the surface of the image holding member with the developer to form a toner image; a transfer device that transfers the toner image onto the surface of a recording medium; and the belt according to the above-described exemplary embodiment.

The image forming apparatus according to the exemplary embodiment is described below with reference to the attached drawing.

FIGURE is a schematic diagram illustrating the image forming apparatus according to the exemplary embodiment. The example of the image forming apparatus illustrated in FIGURE includes the belt according to the exemplary embodiment which serves as an intermediate transfer belt.

Using the belt according to the exemplary embodiment as an intermediate transfer belt may reduce discharging even when a transfer electric field is generated during first transfer or second transfer and limit a reduction in transfer efficiency.

An image forming apparatus 100 according to the exemplary embodiment is, for example, an intermediate-transfer image forming apparatus illustrated in FIGURE, which is commonly referred to as a tandem image forming apparatus. The image forming apparatus 100 includes a plurality of image formation units 1Y, 1M, 1C, and 1K that form yellow (Y), magenta (M), cyan (C), and black (K) toner images by an electrophotographic system; a first transfer section 10 in which the yellow, magenta, cyan, and black toner images formed by the image formation units 1Y, 1M, 1C, and 1K are sequentially transferred (first transfer) to an intermediate transfer belt 15; a second transfer section 20 in which the superimposed toner images transferred on the intermediate transfer belt 15 are collectively transferred (second transfer) to a paper sheet K, which is a recording medium; and a fixing device 60 that fixes the image transferred on the paper sheet K by second transfer to the paper sheet K. The image forming apparatus 100 also includes a controller 40 that controls the operation of each of the devices and the sections.

Each of the image formation units 1Y, 1M, 1C, and 1K included in the image forming apparatus 100 includes a photosensitive member 11 that rotates in the direction of the arrow A, which is an example of the image holding member that holds a toner image formed on the surface.

The photosensitive member 11 is provided with a charger 12 and a laser exposure machine 13 disposed on the periphery of the photosensitive member 11. The charger 12 (an example of a charging unit) charges the photosensitive member 11. The laser exposure machine 13 (an example of a latent image formation unit) writes an electrostatic latent image on the photosensitive member 11 (in FIGURE, an exposure beam is denoted with Bm).

The photosensitive member 11 is also provided with a developing machine 14 and a first-transfer roller 16 disposed on the periphery of the photosensitive member 11. The developing machine 14 (an example of a developing unit) includes a yellow, magenta, cyan, or black toner and visualizes the electrostatic latent image formed on the photosensitive member 11 with the toner. The first-transfer roller 16 transfers the yellow, magenta, cyan, or black toner image formed on the photosensitive member 11 to the intermediate transfer belt 15 in the first transfer section 10.

The photosensitive member 11 is further provided with a photosensitive member cleaner 17 disposed on the periphery of the photosensitive member 11. The photosensitive member cleaner 17 removes toner particles remaining on the photosensitive member 11. The above-described electrophotographic devices, that is, the charger 12, the laser exposure machine 13, the developing machine 14, the first-transfer roller 16, and photosensitive member cleaner 17, are sequentially arranged on the periphery of the photosensitive member 11 in the direction of the rotation of the photosensitive member 11. The image formation units 1Y, 1M, 1C, and 1K are arranged in a substantially linear manner in the order of yellow (Y), magenta (M), cyan (C), and black (K) in the direction of the rotation of the intermediate transfer belt 15.

The intermediate transfer belt 15, which serves as an intermediate transfer body, has a volume resistivity of, for example, $1\times10^{6}$ Ωcm or more and $1\times10^{14}$ Ωcm or less and a thickness of, for example, about 0.1 mm.

The intermediate transfer belt 15 is driven in a circulatory manner (i.e., rotated), by various types of rollers at an intended speed in the direction of the arrow B illustrated in FIGURE. The various types of rollers include a driving roller 31 that is driven by a highly-constant-speed motor (not illustrated) and rotates the intermediate transfer belt 15; a support roller 32 that supports the intermediate transfer belt 15 that extends in a substantially linear manner in the direction in which the photosensitive members 11 are arranged; a tension roller 33 that applies tension to the intermediate transfer belt 15 and serves as a correction roller that prevents meandering of the intermediate transfer belt 15; a backing roller 25 disposed in the second transfer section 20; and a cleaning backing roller 34 disposed on a cleaning section in which toner particles remaining on the intermediate transfer belt 15 are scraped off.

The first transfer section 10 is constituted by first-transfer rollers 16 that are arranged to face the respective photosensitive members 11 across the intermediate transfer belt 15. The first-transfer rollers 16 are arranged to be in pressure contact with the photosensitive members 11 with the intermediate transfer belt 15 interposed between the first-transfer rollers 16 and the photosensitive members 11. The first-transfer rollers 16 are supplied with a voltage (first transfer bias) having a polarity opposite to the polarity (negative; the same applies hereinafter) of charged toner particles. Accordingly, a transfer electric field is generated in the first transfer section 10, and toner images formed on the photosensitive members 11 are electrostatically attracted to the intermediate transfer belt 15 sequentially to form superimposed toner images on the intermediate transfer belt 15.

The second transfer section 20 is constituted by the backing roller 25 and a second transfer roller 22 disposed on a side of the intermediate transfer belt 15 on which the toner image is held.

The backing roller 25 has a surface resistivity of $1\times10^{7}$ Ω/sq or more and $1\times10^{10}$ Ω/sq or less. The degree of hardness of the backing roller 25 is set to, for example, 70° ("ASKER C" produced by KOBUNSHI KEIKI CO., LTD.; the same applies hereinafter). The backing roller 25 is disposed on the rear surface-side of the intermediate transfer belt 15 and serves as a counter electrode for the second transfer roller 22. The backing roller 25 is provided with a power feed roller 26 made of a metal, through which a second transfer bias is applied in a consistent manner.

The second transfer roller 22 is a hollow cylindrical roller having a volume resistivity of $10^{7.5}$ Ωcm or more and $10^{8.5}$ Ωcm or less. The second transfer roller 22 is arranged to be in pressure contact with the backing roller 25 with the intermediate transfer belt 15 interposed between the second transfer roller 22 and the backing roller 25. The second transfer roller 22 is grounded. A second transfer bias is applied between the second transfer roller 22 and the backing roller 25. Accordingly, a transfer electric field is generated in the second transfer section 20, and the toner image formed on the intermediate transfer belt 15 is transferred (second transfer) to a paper sheet K transported to the second transfer section 20.

An intermediate transfer belt cleaner 35 is disposed on the intermediate transfer belt 15 at a position downstream of the second transfer section 20 such that the distance between the intermediate transfer belt cleaner 35 and the intermediate transfer belt 15 can be changed. The intermediate transfer belt cleaner 35 removes toner particles and paper dust particles that remain on the intermediate transfer belt 15 subsequent to the second transfer and cleans the surface of the intermediate transfer belt 15.

The intermediate transfer belt 15, the first transfer section 10 (i.e., the first-transfer rollers 16), and the second transfer section 20 (i.e., the second transfer roller 22) correspond to examples of the transfer unit.

A reference sensor (home position sensor) 42 is disposed upstream of the yellow image formation unit 1Y. The reference sensor (home position sensor) 42 generates a reference signal used as a reference to determine the timings at which images are formed in the image formation units 1Y, 1M, 1C, and 1K. An image density sensor 43 is disposed downstream of the black image formation unit 1K. The image density sensor 43 is used for adjusting image quality. The reference sensor 42 generates the reference signal upon recognizing a mark disposed on the back side of the intermediate transfer belt 15. Upon recognizing the reference signal, the controller 40 sends a command to the image formation units 1Y, 1M, 1C, and 1K. Each of the image formation units 1Y, 1M, 1C, and 1K starts forming an image in accordance with the command.

The image forming apparatus according to the exemplary embodiment further includes the following components as units for transporting paper sheets K: a paper tray 50 that contains paper sheets K; a paper feed roller 51 that draws and transports a paper sheet K stocked in the paper tray 50 at predetermined timings; transport rollers 52 that transport the paper sheet K drawn by the paper feed roller 51; a transport guide 53 with which the paper sheet K transported by the transport rollers 52 is fed into the second transfer section 20; a transport belt 55 that transports the paper sheet K that has been subjected to the second transfer with the second transfer roller 22 to the fixing device 60; and a fixing entrance guide 56 with which the paper sheet K is introduced into the fixing device 60.

A fundamental process for forming an image using the image forming apparatus according to the exemplary embodiment is described below.

In image forming apparatus according to the exemplary embodiment, image data sent from an image reading apparatus (not illustrated), a personal computer (PC, not illustrated), or the like are subjected to image processing using an image processing apparatus (not illustrated) and, subsequently, the image formation units 1Y, 1M, 1C, and 1K form images.

In the image processing apparatus, the input reflectance data are subjected to image processing that includes various types of image editing, such as shading correction, misalignment correction, lightness/color space conversion, gamma correction, frame removal, color editing, and image moving. The image data that have been subjected to the image processing are converted into yellow, magenta, cyan, and black colorant gradation data and sent to the laser exposure machines 13.

In accordance with the colorant gradation data received by each of the laser exposure machines 13, the laser exposure machine 13 irradiates the photosensitive member 11 included in each of the image formation units 1Y, 1M, 1C, and 1K with an exposure beam Bm emitted from a semiconductor laser or the like. After the surface of the photosensitive member 11 of each of the image formation units 1Y, 1M, 1C, and 1K has been charged by the charger 12, the surface of the photosensitive member 11 is scanned by the laser exposure machine 13 and exposed to the beam and, consequently, an electrostatic latent image is formed on the surface of the photosensitive member 11. The electrostatic latent image is developed in each of the image formation units 1Y, 1M, 1C, and 1K as Y, M, C, or K toner image.

The toner images formed on the photosensitive members 11 of the image formation units 1Y, 1M, 1C, and 1K are transferred to the intermediate transfer belt 15 in the first transfer section 10 in which the photosensitive members 11 come into contact with the intermediate transfer belt 15. Specifically, in the first transfer section 10, the first-transfer rollers 16 apply a voltage (first transfer bias) having a polarity opposite to the polarity (negative) of charged toner particles to the base of the intermediate transfer belt 15 and the toner images are sequentially superimposed on the surface of the intermediate transfer belt 15 (first transfer).

After the toner images have been sequentially transferred (first transfer) onto the surface of the intermediate transfer belt 15, the intermediate transfer belt 15 is moved and the toner images are transported to the second transfer section 20. When the toner images are transported to the second transfer section 20, in the transport unit, the paper feed roller 51 starts rotating and feeds a paper sheet K having an intended size from the paper tray 50 in synchronization with the transportation of the toner images to the second transfer section 20. The paper sheet K fed by the paper feed roller 51 is transported by the transport rollers 52 and reaches the second transfer section 20 through the transport guide 53. Before the paper sheet K reaches the second transfer section 20, the feeding of the paper sheet K is temporarily paused and an alignment between the paper sheet K and the toner images is made by an alignment roller (not illustrated) being rotated in synchronization with the movement of the intermediate transfer belt 15 on which the toner images are held.

In the second transfer section 20, the second transfer roller 22 is pressed by the backing roller 25 with the intermediate transfer belt 15 interposed between the second transfer roller 22 and the backing roller 25. The paper sheet K transported to the second transfer section 20 at the intended timing becomes inserted between the intermediate transfer belt 15 and the second transfer roller 22. Upon a voltage (second transfer bias) having a polarity that is the same as the polarity (negative) of charged toner particles being applied by the power feed roller 26, a transfer electric field is generated between the second transfer roller 22 and the backing roller 25. The unfixed toner images held on the intermediate transfer belt 15 are electrostatically transferred to the paper sheet K collectively in the second transfer section 20, which is pressurized by the second transfer roller 22 and the backing roller 25.

The paper sheet K on which the toner images have been electrostatically transferred is subsequently removed from the intermediate transfer belt 15 and immediately transported by the second transfer roller 22 to the transport belt 55, which is disposed downstream of the second transfer roller 22 in the direction in which paper sheets are transported. The transport belt 55 transports the paper sheet K to the fixing device 60 in accordance with the transportation speed optimum for the fixing device 60. The unfixed toner images present on the paper sheet K transported to the fixing device 60 are fixed to the paper sheet K by heat and pressure in the fixing device 60. The paper sheet K on which the fixed image has been formed is transported to a paper eject tray (not illustrated) disposed in an ejecting section of the image forming apparatus.

Toner particles that remain on the intermediate transfer belt 15 after the termination of the transfer to the paper sheet K are transported to the cleaning section due to the rotation of the intermediate transfer belt 15 and removed from the intermediate transfer belt 15 by the cleaning backing roller 34 and the intermediate transfer belt cleaner 35.

The exemplary embodiments are described above. It should be understood that the above-described exemplary embodiments are not restrictive, and many modifications, variations, and improvements may be made to the exemplary embodiments.

EXAMPLES

Examples of the present disclosure are described below. Note that, the present disclosure is not limited by Examples below. In the following description, "part" and "%" are all on a mass basis.

Example 1

Preparation of Coating Liquid A

Carbon black particles "SPECIAL BLACK 4" (average primary particle size: 25 μm) produced by Orion Engineered Carbons are added to an N-methyl-2-pyrrolidone (NMP) solution (solid component concentration: 22 mass %) of a polyamic acid produced from 3,3',4,4'-biphenyltetracarboxylic dianhydride and 4,4'-diaminodiphenyl ether such that the amount of carbon black particles is 27 parts by mass relative to 100 parts by mass of the resin solid component (i.e., 27 per hundred resin (phr)). The resulting mixture is stirred and dispersed with a jet mill to form a coating liquid A.

Preparation of Coating Liquid B

Carbon black particles "COLOR BLACK FW1" (average primary particle size: 13 μm) produced by Orion Engineered Carbons are added to an N-methyl-2-pyrrolidone (NMP) solution (solid component concentration: 21 mass %) of a polyamideimide resin "HPC-9000" produced by Hitachi Chemical Co., Ltd. such that the amount of the carbon black particles is 19 parts by mass relative to 100 parts by mass of the resin solid component. The resulting mixture is stirred and dispersed to form a coating liquid B.

Formation of Second Layer

A hollow stainless steel cylinder having an outside diameter of 278 mm and a length of 600 mm is prepared.

While the cylinder is rotated, the coating liquid A is applied onto the outer surface of the cylinder by spiral coating. Subsequently, while the cylinder is held horizontally, the resulting coating film is dried by heating at 140° C. for 30 minutes to form a second layer.

Formation of First Layer

While the cylinder is rotated, the coating liquid B is applied, by spiral coating, to the second layer prepared in the above-described manner. Subsequently, while the cylinder is held horizontally, the resulting coating film is dried by heating at 140° C. for 15 minutes to form a first layer.

Imidization

The cylinder on which the first and second layers have been formed is heated at 320° C. for 1 hour in order to perform imidization of the polyamic acid.

The first and second layers are subsequently removed from the cylinder and cut to a length of 350 mm. Hereby, a belt of Example 1 is prepared.

Example 2

A belt of Example 2 is prepared as in Example 1, except that the thicknesses of the first and second layers are changed as described in Table 1 below.

Examples 3 to 5

Belts of Examples 3 to 5 are prepared as in Example 1, except that the amount of the carbon black particles included in the first layer, the content of the carbon black particles in the first layer, and the thicknesses of the first and second layers are changed as described in Table 1 below.

Example 6

A belt of Example 6 is prepared as in Example 1, except that the carbon black particles included in the first layer are changed to carbon black particles "SPECIAL BLACK 6" (average primary particle size: 17 μm) produced by Orion Engineered Carbons and that the amount of the carbon black particles included in the first layer and the content of the carbon black particles in the first layer are changed as described in Table 1 below.

Example 7

A belt of Example 7 is prepared as in Example 1, except that the coating liquid C described below is used for forming the first layer.

Preparation of Coating Liquid C

Carbon black particles "COLOR BLACK FW1" (average primary particle size: 13 μm) produced by Orion Engineered Carbons are added to an N-methyl-2-pyrrolidone (NMP) solution (solid component concentration: 22 mass %) of a polyamic acid produced from 3,3',4,4'-biphenyltetracarboxylic dianhydride and 4,4'-diaminodiphenyl ether such that the amount of carbon black particles is 19 parts by mass relative to 100 parts by mass of the resin solid component (i.e., 19 phr). The resulting mixture is stirred and dispersed with a jet mill to form a coating liquid C.

Example 8

A belt of Example 8 is prepared as in Example 1, except that the thicknesses of the first and second layers are changed as described in Table 1 below.

Comparative Example 1

A belt of Comparative example 1 is prepared as in Example 1, except that the amount of the carbon black particles added to the coating liquid B is changed from 19 parts by mass to 12 parts by mass.

Comparative Example 2

A belt of Comparative example 2 is prepared as in Example 1, except that the carbon black particles included in the first layer are changed to carbon black particles "SPECIAL BLACK 4" (average primary particle size: 25 μm) produced by Orion Engineered Carbons and that the amount of the carbon black particles included in the first layer and the content of the carbon black particles in the first layer are changed as described in Table 1 below.

Comparative Example 3

A belt of Comparative example 3 is prepared as in Example 1, except that the amount of the carbon black particles added to the coating liquid B is changed from 19 parts by mass to 31 parts by mass.

Comparative Example 4

A belt of Comparative example 4 is prepared as in Example 1, except that the thickness of the second layer is changed to 80 μm and that the first layer is not formed.

That is, the belt of Comparative example 4 is a single-layer belt consisting only of the second layer having a thickness of 80 μm.

Comparative Example 5

After a second layer has been formed as in Example 1, the coating liquid D described below is applied to the second layer by spiral coating. The resulting coating film is baked at 140° C. for 20 minutes to form a first layer having a thickness of 5 μm. Hereby, a belt of Comparative example 5 is prepared.

Preparation of Coating Liquid D

To butyl acetate (solvent), 100 parts of a curable resin "ZEFFLE (registered trademark) GK-510" produced by Daikin Industries, Ltd. and 30 parts of carbon black particles "SPECIAL BLACK 4" produced by Orion Engineered Carbons are added. The resulting liquid mixture is dispersed with a jet mill disperser "GeanusPY" produced by Geanus (pressure: 200 N/mm$^2$, collisional frequency: 5 passes) to form a resin solution. The resin solution is passed through a 20-μm stainless steel mesh in order to remove foreign matter, aggregates of carbon black, and the like. Subsequently, the solution is degassed by vacuum to form a final resin solution.

Then, 20 parts of "TAKENATE D-140N" produced by Mitsui Chemicals, Inc. and 20 parts of "SUMIDUR N-3300 produced by Sumika Bayer Urethane Co., Ltd., which serve as a curing agent, relative to 100 parts of the curable resin included in the resin solution are mixed with the resin solution. Hereby, a coating liquid D is prepared.

Measurements and Evaluations

Each of the belts prepared in Examples is subjected to the measurements and evaluations described below.

For each of the belts prepared in Examples, the average size of carbon black particles exposed at the outer peripheral surface of the belt, the area fraction of the carbon black particles exposed at the outer peripheral surface of the belt to the outer peripheral surface of the belt, the number of the conducting points present on the belt, and the volume resistivity of the belt are measured by the above-described methods.

In addition, for each of the belts prepared in Examples, the average primary particle sizes of the carbon black particles included in first and second layers, the surface roughness Rz of the outer peripheral surface of the belt, the thicknesses of the first and second layers, and the surface resistivity values of the belt are measured by the above-described methods.

Table 1 summarizes the measurement results.

The folding endurance number of each of the belts prepared in Examples which is based on an MIT test is also measured by the above-described method. Table 2 summarizes the results.

Evaluation of Discharging

Each of the belts prepared in Examples is evaluated in terms of discharging by the following method.

Each of the belts prepared in Examples is cut to a size of 50 mm×50 mm. The specimen is placed on an electrically conductive rubber sheet having a thickness of 5 mm. An electrically conductive substrate composed of a transparent material is arranged parallel to the belt over the electrically conductive rubber sheet at a spacing of 100 μm. A predetermined amount of voltage is applied to the electrically conductive rubber sheet, and discharge light generated on the electrically conductive substrate is observed in a darkroom with a high-speed high-sensitivity camera. The evaluation of discharging is made in accordance with the following criteria.

G1 (Good): Few discharge light is generated.

G2 (Poor): Faint discharge light is generated.

G3 (Bad): Discharge light is steadily generated.

Table 2 summarizes the results.

Evaluation of Transfer Efficiency

Each of the belts prepared in Examples is used as an intermediate transfer belt and evaluated in terms of transfer efficiency by the following method.

Each of the belts prepared in Examples is attached to an image forming apparatus "Apeos Port VI C7773" produced by Fuji Xerox Co., Ltd. and used as an intermediate transfer belt.

An image containing 3 cm×3 cm solid (density: 100%) cyan patches is formed using the image forming apparatus. In the second transfer step, hard stop is done and the weight "a" of toner particles before the second transfer and the weight "b" of toner particles remaining on the intermediate transfer belt after the second transfer are measured. The transfer efficiency is calculated using the following formula.

$$\text{Transfer efficiency [\%]}=(a-b)/a\times 100$$

Table 2 summarizes the results.

It is considered that, the higher the transfer efficiency, the higher the degree of reduction of local discharging in the transfer electric field.

Evaluation of Transferability to Embossed Paper

Each of the belts prepared in Examples is used as an intermediate transfer belt and evaluated in terms of transferability by the following method.

Each of the belts prepared in Examples is attached to an image forming apparatus "Apeos Port VI C7773" produced by Fuji Xerox Co., Ltd. The quality of an image formed using the image forming apparatus is evaluated.

In the image quality evaluation, an embossed paper sheet "LEATHAC 66" (250 gsm) is used. A solid image of black halftone (image density: 60%) is evaluated in accordance with the following criteria.

G1 (Excellent): White spots are absent at the recesses on the paper sheet.

G2 (Good): Few white spots are present at the recesses on the paper sheet.

G3 (Poor): White spots are slightly present at the recesses on the paper sheet.

G4 (Bad): White spots are present at most of the recesses on the paper sheet.

Table 2 summarizes the results.

Evaluation of Endurance to Printing

As in the evaluations of transfer efficiency and transferability, each of the belts prepared in Examples is attached to an image forming apparatus "Apeos Port VI C7773" produced by Fuji Xerox Co., Ltd. and used as an intermediate transfer belt and the mechanical endurance of the belt is determined.

The belts prepared in Examples 1 to 7 do not rupture even after printing of 100,000 paper sheets.

TABLE 1

| | First layer | | | | | | | | Second layer | |
|---|---|---|---|---|---|---|---|---|---|---|
| | Outer peripheral surface | | | | | | | | | |
| | Size of exposed CB particles [nm] | Area fraction of exposed CB particles [%] | Rz [μm] | Size of CB particles [nm] | Amount of CB added [phr] | CB Content [mass %] | Resin type | Thickness [μm] | Size of CB particles [nm] | Amount of CB added [phr] |
| Example 1 | 5-100 | 8 | 0.07 | 13 | 19 | 16 | PAI | 5 | 25 | 27 |
| Example 2 | 5-100 | 9 | 0.08 | 13 | 19 | 16 | PAI | 10 | 25 | 27 |
| Example 3 | 5-100 | 10 | 0.08 | 13 | 20 | 17 | PAI | 20 | 25 | 27 |
| Example 4 | 5-125 | 22 | 0.07 | 13 | 20 | 17 | PAI | 5 | 25 | 27 |
| Example 5 | 5-150 | 30 | 0.09 | 13 | 21 | 17 | PAI | 5 | 25 | 27 |
| Example 6 | 5-120 | 23 | 0.08 | 17 | 21 | 17 | PAI | 5 | 25 | 27 |

TABLE 1-continued

| | | | | | | | | | | |
|---|---|---|---|---|---|---|---|---|---|---|
| Example 7 | 5-100 | 9 | 0.07 | 13 | 19 | 16 | PI | 10 | 25 | 27 |
| Example 8 | 5-100 | 9 | 0.08 | 13 | 19 | 16 | PAI | 40 | 25 | 27 |
| Comparative example 1 | 5-100 | 2 | 0.07 | 13 | 12 | 11 | PAI | 5 | 25 | 27 |
| Comparative example 2 | 200-500 | 13 | 0.08 | 25 | 18 | 15 | PAI | 5 | 25 | 27 |
| Comparative example 3 | 5-100 | 8 | 0.07 | 13 | 31 | 24 | PAI | 5 | 25 | 27 |
| Comparative example 4 | 200-500 | 13 | 0.08 | — | — | — | — | — | 25 | 27 |
| Comparative example 5 | 300-700 | 22 | 0.38 | 13 | 18 | 15 | FP | 5 | 25 | 27 |

| | Second layer | | | Number of | | Surface | Surface | | Ratio of first layer thickness |
|---|---|---|---|---|---|---|---|---|---|
| | CB Content [mass %] | Resin type | Thickness [μm] | conducting points [point] | Volume resistivity [logΩ · cm] | resistivity ρs1 [logΩ/sq] | resistivity ρs2 [logΩ/sq] | ρs1 − ρs2 | to overall thickness [%] |
| Example 1 | 21 | PI | 75 | 96 | 11.81 | 12.43 | 12.45 | 0.02 | 6.3 |
| Example 2 | 21 | PI | 75 | 98 | 12.47 | 12.32 | 12.31 | 0.01 | 11.8 |
| Example 3 | 21 | PI | 65 | 126 | 11.12 | 12.04 | 11.76 | 0.28 | 23.5 |
| Example 4 | 21 | PI | 75 | 250 | 10.90 | 11.20 | 11.18 | 0.02 | 6.3 |
| Example 5 | 21 | PI | 75 | 240 | 10.20 | 11.02 | 10.92 | 0.10 | 6.3 |
| Example 6 | 21 | PI | 75 | 85 | 11.83 | 12.32 | 12.23 | 0.09 | 6.3 |
| Example 7 | 21 | PI | 75 | 93 | 12.67 | 12.42 | 12.41 | 0.01 | 11.8 |
| Example 8 | 21 | PI | 40 | 98 | 13.00 | 12.24 | 12.22 | 0.02 | 50.0 |
| Comparative example 1 | 21 | PI | 75 | 64 | 13.05 | 11.49 | 11.24 | 0.25 | 6.3 |
| Comparative example 2 | 21 | PI | 75 | 53 | 10.10 | 11.00 | 10.50 | 0.50 | 6.3 |
| Comparative example 3 | 21 | PI | 75 | 93 | 9.30 | 9.90 | 10.10 | 0.20 | 6.3 |
| Comparative example 4 | 21 | PI | 80 | 27 | 9.80 | 10.20 | 10.20 | 0.00 | 0.0 |
| Comparative example 5 | 21 | PI | 80 | 14 | 11.00 | 11.00 | 10.50 | 0.50 | 5.9 |

Details of the abbreviations used in Table 1 are described below.

CB: Carbon black particles

PAI: Polyamideimide resin

PI: Polyimide resin

FP: Fluorine-containing resin (Tetrafluoroethylene/Vinyl Monomer Copolymer)

TABLE 2

| | Evaluations | | | |
|---|---|---|---|---|
| | Discharging | Transfer efficiency [%] | Folding endurance number [times] | Transferability to embossed paper |
| Example 1 | G1 (Good) | 97 | 4000 | G1 (Excellent) |
| Example 2 | G1 (Good) | 96 | 3250 | G1 (Excellent) |
| Example 3 | G1 (Good) | 96 | 3000 | G1 (Excellent) |
| Example 4 | G1 (Good) | 98 | 3100 | G1 (Excellent) |
| Example 5 | G1 (Good) | 97 | 3150 | G1 (Excellent) |
| Example 6 | G1 (Good) | 95 | 3000 | G2 (Good) |
| Example 7 | G1 (Good) | 97 | 3300 | G2 (Good) |
| Example 8 | G1 (Good) | 94 | 800 | G2 (Good) |
| Comparative example 1 | G2 (Poor) | 87 | 3900 | G3 (Poor) |
| Comparative example 2 | G3 (Bad) | 84 | 3945 | G4 (Bad) |
| Comparative example 3 | G2 (Poor) | 82 | 3900 | G3 (Poor) |
| Comparative example 4 | G3 (Bad) | 90 | 4000 | G4 (Bad) |
| Comparative example 5 | G3 (Bad) | 88 | 2800 | G3 (Poor) |

The results described in Table 2 confirm that the belts prepared in Examples achieve higher transfer efficiency and are less likely to discharge in an electric field than the belts prepared in Comparative examples.

It is also confirmed that the belts prepared in Examples achieve high transferability to embossed paper sheets.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt comprising:

a first layer defining an outer peripheral surface of the belt; and a second layer arranged adjacent to the first layer, the first layer and the second layer including a polyimide-based resin, the first layer including carbon black particles, wherein a part of the carbon black particles which are exposed at the outer peripheral surface of the belt has a size of 5 nm or more and 150 nm or less, an area fraction of the part of the carbon black particles which are exposed at the outer peripheral surface of the belt to the outer peripheral surface of the belt is 2% or more and 35% or less, the belt includes 80 or more conducting points per square micrometer, the belt has a volume resistivity of 10 log Ω·cm or more, and the outer peripheral surface of the belt has a surface roughness Rz of 0.2 μm or less.

2. The belt according to claim 1, wherein the carbon black particles included in the first layer have an average primary particle size of 2 nm or more and 20 nm or less.

3. The belt according to claim 1, wherein an amount of the carbon black particles included in the first layer is 15% by mass or more of a total mass of the first layer.

4. The belt according to claim 2, wherein an amount of the carbon black particles included in the first layer is 15% by mass or more of a total mass of the first layer.

5. The belt according to claim 3, wherein the amount of the carbon black particles included in the first layer is 15% by mass or more and 30% by mass or less of the total mass of the first layer.

6. The belt according to claim 4, wherein the amount of the carbon black particles included in the first layer is 15% by mass or more and 30% by mass or less of the total mass of the first layer.

7. The belt according to claim 1, wherein the polyimide-based resin included in the first layer is a polyamideimide resin.

8. The belt according to claim 2, wherein the polyimide-based resin included in the first layer is a polyamideimide resin.

9. The belt according to claim 1, wherein the outer peripheral surface of the belt has a surface roughness Rz of 0.15 or less.

10. The belt according to claim 1, wherein the outer peripheral surface of the belt has a surface roughness Rz of 0.1 or less.

11. The belt according to claim 1, wherein the second layer includes carbon black particles, and wherein the carbon black particles included in the second layer have an average primary particle size of more than 20 nm and 40 nm or less.

12. The belt according to claim 1, wherein an amount of the carbon black particles included in the second layer is 10% by mass or more and 40% by mass or less of a total mass of the second layer.

13. The belt according to claim 12, wherein the amount of the carbon black particles included in the second layer is 20% by mass or more and 30% by mass or less of the total mass of the second layer.

14. The belt according to claim 1, wherein a ratio of an amount of the carbon black particles included in the first layer to an amount of the carbon black particles included in the second layer is 0.6 or more and 0.8 or less.

15. The belt according to claim 1, wherein the polyimide-based resin included in the second layer is a polyimide resin.

16. The belt according to claim 1, wherein a ratio of a thickness of the first layer to a total thickness of the first layer and the second layer is 3% or more and 25% or less.

17. A belt comprising:

a first layer defining an outer peripheral surface of the belt; and a second layer arranged adjacent to the first layer, the first layer and the second layer including a polyimide-based resin, the first layer including carbon black particles, wherein a part of the carbon black particles which are exposed at the outer peripheral surface of the belt has a size of 5 nm or more and 150 nm or less, an area fraction of the part of the carbon black particles which are exposed at the outer peripheral surface of the belt to the outer peripheral surface of the belt is 2% or more and 35% or less, the belt includes 80 or more conducting points per square micrometer, the belt has a volume resistivity of 10 log Ω·cm or more, and Formulae (1) and (2) below are satisfied, $$\rho s1 \geq 10.9 \log \Omega/sq \quad (1)$$

$$0 < |\rho s1 - \rho s2| \leq 0.3 \quad (2)$$

where ρs1 represents a surface resistivity of the outer peripheral surface of the belt, and ρs2 represents a surface resistivity of a surface of the belt which is opposite to the outer peripheral surface of the belt.

18. A belt comprising:

a first layer defining an outer peripheral surface of the belt; and a second layer arranged adjacent to the first layer, the first layer and the second layer including a polyimide-based resin, the first layer including carbon black particles, wherein a part of the carbon black particles which are exposed at the outer peripheral surface of the belt has a size of 5-nm or more and 150 nm or less, an area fraction of the par of the carbon black particles which are exposed at the outer peripheral surface of the belt to the outer peripheral surface of the belt is 2% or more and 35% or less, the belt includes 80 or more conducting points per square micrometer, the belt has a volume resistivity of 10 log Ω·cm or more, and having a folding endurance number of 3,000 or more, the folding endurance number being measured by an MIT test using a clamp having a curvature radius R of 0.38 mm.

19. An intermediate transfer belt comprising the belt according to claim 1.

20. An image forming apparatus comprising the belt according to claim 1.

* * * * *